United States Patent [19]

Dubach

[11] 4,320,843

[45] Mar. 23, 1982

[54] FOR BOTTLE OR THE LIKE, COMPRISING TEARABLE TENSIONING MEANS AS WARRANTY

[76] Inventor: Werner F. Dubach, Hubrainstrasse 4a, 8124 Maur, Switzerland

[21] Appl. No.: 135,319

[22] Filed: Mar. 31, 1980

[30] Foreign Application Priority Data

Mar. 30, 1979 [CH] Switzerland ..... 2973/79

[51] Int. Cl.[3] ..... B65D 41/48

[52] U.S. Cl. ..... 215/256

[58] Field of Search ..... 215/253, 254, 256, 305, 215/320, DIG. 1

[56] References Cited

U.S. PATENT DOCUMENTS 3,142,403 7/1964 Fox ..... 215/320 X
3,164,278 1/1965 Lohrer ..... 215/320
3,254,785 6/1966 Lovell ..... 215/305
3,494,496 2/1970 Livingstone ..... 215/320
3,990,598 11/1976 Zapp et al. ..... 215/305 X

*Primary Examiner*—Donald F. Norton
*Attorney, Agent, or Firm*—Heinrich W. Herzfeld

[57] ABSTRACT

The invention relates to a closure means for instance seated on a bottle and hermetically sealing it. The closure means preferably is shaped like a cap comprising at least one slitting by means of which the side wall of the cap spreads when being set. The cap furthermore comprises an inside annular bead and a sealing collar for hermetically sealing the cap onto the bottle. The cap further comprises a lift-off element for easy reopening and at least one tear-off tensioning member spanning the slitting so as to counteract spreading and acting as a warranty signet.

8 Claims, 8 Drawing Figures

Fig. 7
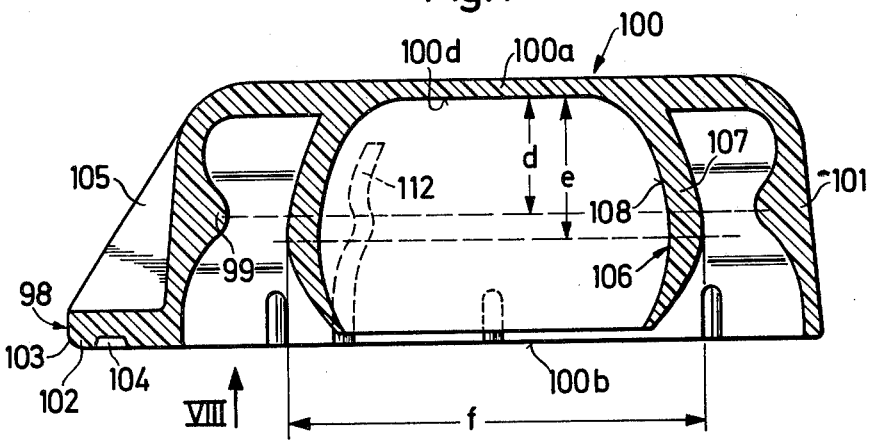
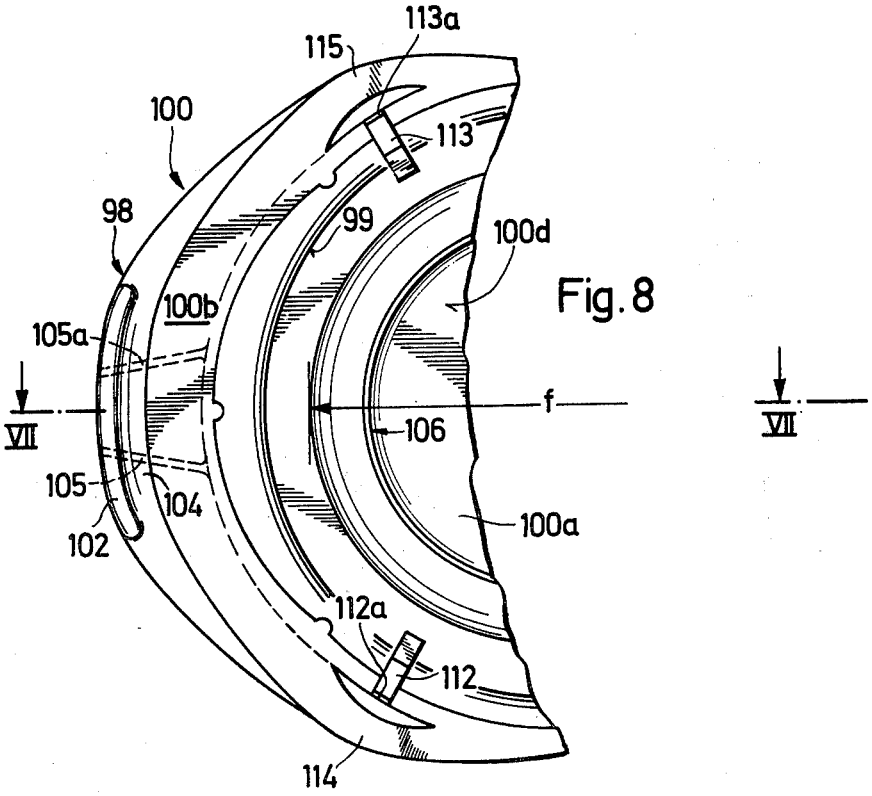
Fig. 8

FOR BOTTLE OR THE LIKE, COMPRISING TEARABLE TENSIONING MEANS AS WARRANTY

BACKGROUND OF THE INVENTION

The invention relates to a closure for hermetically sealing, while nevertheless allowing easy reopening, a bottle or a similar container having a neck with a discharge orifice, a neck end surface surrounding the orifice, and below the neck end surface a mouth lip in the form of an annular bead with a constriction at its lower side, the said closure comprising a cap as the sealing head with a roof wall and cap side walls extending around the roof wall, with a slitting for the purpose of spreading when the cap is set on the bottle mouth which slitting extends from the lower mouth rim transversely to it, and with an inside annular bead on the cap side wall projecting inward for the purpose of gripping the lower side of the mouth lip of the bottle when in the closed position, further a sealing element for sealing the discharge orifice of the bottle when in closed position, further a finger-actuated lift element on the actuation side of the cap, and further a fastening device spanning in annular manner each of the slits present in the cap side wall when in the closed position by hermetically pressing the inside annular bead of the cap side wall of the bottle against the constricted lower side of the lip of the bottle mouth, the said fastening device comprising at least one tensioning (or "clamping") means which in the closed position of the bottle is tensioned by stresses tangential to the cap side wall, and thereby prevents the spreading of each slit present in the side wall, and an omnidirectional uniform pressing of the annular inside bead against the lower side of the lip of the bottle neck moutn.

Such a closure means already is known from Swiss Pat. No. 605 306 of REFIL Aktiengesellschaft at Triesenberg, Duchy of Liechtenstein and from their German Offenlegungsschrift No. 2 554 887.

Now it was found with respect to that closure means that when it is manufactured by the injection molding method, the material will concentrate more on the production tool than was the case originally for prototype production. This makes the overall closure means stiffer, the bridging members in the form of straps bridging the slits are less elastic, the closure means must be emplaced with higher compression in the filling process, and most of all, greater effort is required when first opening the bottle, or another container, when lifting the pull-off nose (lifting element), and again replacing it is that much more difficult.

On the other hand, this substantially more rigid closure means is not substantially more resistant to internal pressure than one made from a less dense material which is correspondingly more elastic.

In order to pasteurize the bottle contents, the temperature must be raised at least to 62° C. for at least 20 minutes; the closure means to-date however withstands only a temperature of 56° C. Accordingly it must be made of a still harder material. If the closure means hower shall withstand these pasteurizing conditions, it will be even more difficult to put it on and take it off a bottle mouth.

OBJECTS AND SUMMARY OF THE INVENTION

It is therefore the object of the present invention to so improve the above described closure means that it withstands pasteurizing conditions without losing its hermeticity or be blown off, and simultaneously to lend itself to be put on or taken off as easily as that made of softer material.

This problem is solved, and further objects which will be made clear below are obtained by an improved closure means of the initially cited kind which is characterized in that the tensioning member of at least one slit can be torn open at least on one side of said slit when the closure means is opened for the first time, whereby, when the closure postion is resumed, the tangential tensioning and hence the compression for the particular slit are partly eliminated at the torn clamping member.

The tear-up clamping member also may comprise webs or straps on both sides of the slits it spans in lieu of a single one, which connect it to the cap side wall. When the strap of a tensioning member is torn open only on one side of the slit, this slit already is much easier to spread. Accordingly tearing open much facilitates the removal of a closure means which for instance under pasteurizing conditions sits very tightly and can be removed only practically using a tool ( in the manner of a bottle opener), and its resetting, by hand only, on the still partly filled bottle presents no difficulties. Obviously the remaining contents of the bottle no longer are sealed as tightly as when opening this bottle for the first time, but these contents also will be soon consumed.

Tearing open the strap of a clamping member, and hence the reduction of its tangential tension when the closure means is placed on the bottle, at the same time also indicates that the bottle was opened after its being originally filled. The untorn strap therefore serves as signet of warranty.

Further, the slitting of the cap side wall may consist of at least two slits distributed in the same manner across the opposite sectors between the actuation side and the opposite side of the cap side wall, and one tensioning member may be provided for each slit; each tensioning member spanning the slit is arcuate and will stretch elastically when the slit is spread; it is joined to the cap side wall on both sides of and close to the slit it spans. Each of the two tensioning members may comprise at least on one side of the slit it spans the above mentioned strap which joins it to the cap side wall and which can be torn up in the tangential direction.

The lifting element provided on the actuation side can be joined rigidly and integral with the cap side wall, and at least one tear-up tensioning member can comprise a pull-up arm extending on the side, away from the lifting element, of the pertinent slit away from latter along the cap side wall.

The pull-up arm can comprise a small tear-up strip, toward its free end by means of which strip it is joined to the cap side wall. Where two tensioning members are present, a bridge element may be provided which extends along the circumference of the cap side wall and connects the tensioning members together, and each tensioning member may comprise a strap which tears open in the tangential direction and is located on the side which is between the slit it spans and the bridge element. Said strap connecting it to the cap side wall. In that case the bridge element preferably extends along the lifting element. The bridge element too may comprise at least one tear-open strap by which it is connected to the cap side wall or to the lifting element.

Preferably then the region of the bridge element in front of the forward side of the lifting element will be free of straps and can be lifted off the lifting element prior to the first opening of the closure means, the lifting element remaining in the closed position until the strap connection of at least one of the clamping members to the cap side wall is torn open on at least one side of the slit it spans. Only then the lift-off of the lifting element by slight finger pressure will take place, the force applied being slightly larger than that required for tearing up the straps.

The slitted cap closure of the invention furthermore may comprise a number of improvements apart from of the tear-up bridge means of one or more slits.

Among the improvements is that of the lift-up nose. The sharp lower front edge of the nose may cut into the finger performing the lifting motion and may induce pain.

The invention therefore provides a lift off bead of preferably semi-circular cross-section at the lower side of the lift-off nose, one side-wall of said bead being flush with the end face of the lift-off nose, whereby the sharp front edge of the lower side of the lift-off beak is eliminated. Two bracing means at the upper side of the lift-off nose are correspondingly extended practically as far as the circumferential rim of cap surface, so that when pressing the finger on the lift-off bead at the lower side of the lift-off beak, not only will the lowermost region of the cap side wall be somewhat lifted, but also the entire front region of the cap side wall together with the area comprised therein of the inside annular bead is bent slightly forward and away from the top of the mouth of the bottle.

However it was found that the rounded-off lifting bead, if projecting from the lower sealing surface of the sealing cap, can cause difficulties when the caps are machine-fed in a cap-sealing machine, namely that obliquely positioned caps will move on top of each other and jam in the machine.

This is prevented in the invention by the lower side of the lift-off nose extending parallel to the plane of the lower sealing cap rim though somewhat above it, and by the lift-off bead projecting from the lower side of the lift-off nose only so much that it extends at most as far as the said rim plane at the lower cap end, but not beyond, in the downward direction. Thereby the lower side of the sealing cap reliably remains flatly resting on the conveyor belt, even in the presence of vibrations, as when fed into the machine, and the chances of one cap coming on top of another due to its oblique position is averted.

A further important improvement in the slitted cap allowing seating the sealing cap in solid, well hermetic manner, and nevertheless easy lift-off, rests on the combination of the following features:

(a) an upper cap wall which is continuous and essentially plane, i.e. without or only with a slight center trough, (b) a collar directed from the inside of the upper wall into the mouth of the bottle for the purpose of guidance and sealing, of which the outer side wall encloses a spherical zone at its center region, the inside side wall of the collar preferably being curved inward in a concave manner so that the cross-section of the same resembles an elephant tusk, and (c) an inside annular bead in the inner cap side wall, of which the cross-section at least approximately is of semi-circular shape.

Preferably the side wall of the collar tapers slightly from a zone of maximum thickness toward its juncton at the cap upper wall. Thereby the maximum collar outside diameter of the closure means of the invention is so much underneath the upper wall that, when the cap is set on a bottle mouth in machine operation, first the outer collar side wall makes a hermetic seal with the inside mouth wall of the bottle, and only after this has been achieved will the inside bead of the cap side wall in the course of further depression of the cap make a tight contact with an outer region of the mouth of the bottle.

This is most reliably achieved independently of the geometry of the longitudinal section through the bottle neck if the plane of the maximum outside diameter of the collar outside wall is lower, that is at a larger spacing from the inside of the cup upper wall, than the plane through the smallest inside width of the inside annular bead.

To that end the collar must be relatively long, that is, it must extend relatively deep into the mouth-neck of the bottle. If the collar is so short that, upon its introduction, the end of the mouth of the bottle is first sealed by the inside annular bead of the cap side wall and only then by the spherical dome of the seal, then the air in the cap outside the collar will be forced into the mouth of the bottle.

This embodiment also achieves especially easy lift-off when half the inside width of the inside annular bead from the center axis of the cap to the inside annular bead on the lift-off side is less than the spacing from the cap center axis to the inside annular bulge in a region of the cap side wall which is at right angle to the lift-off side.

Preferably the difference between the inside width of the inside annular bead, measured from the lift-off side to the opposite one, on one hand, and the inside width of the inside annular bead on the other, measured orthogonally thereto, will be about 0.5 to 2 mm.

In the above described preferred embodiment of the slitted closure cap with a collar of elephant-tusk cross-section, air from the inside of the cap when being set on the bottle can escape to the ambient and will not be forced into the inside of the collar above the liquid in the bottle, as in the case for many known closure means. The less the amount of air in the tightly sealed bottle above the liquid, the better this liquid will keep, in particular where beer is concerned.

As the inside pressure in a bottle sealed with a closure of the invention increases, the upper cap wall above the collar inside bulges rather substantially outward. This bulge may amount up to 2 mm in bottles of standard sizes. The sealing collar is also raised in the process, without degradation in sealing as regards the last described embodiment, as the collar is especially long in that case, i.e., it extends especially far in the axial direction into the mouth of the bottle.

In this respect, the outside spherical surface of the collar is especially suited to ensure a hermetic seal to the inside wall of the bottle mouth even when the angle between collar and upper wall in the closure cap of the invention is varied.

If the spherical zone of the collar with the largest radius comes into the region of the upper inner mouth rim—which is the case for a correspondingly high internal pressure, for instance for 6 atmospheres gauge— then air will pass from the region of the mouth along the mouth curvature into the outer inside space, the spherical zone of maximum diameter, with straightening of the cap upper wall, then penetrates more into the mouth and seals again.

The angle between the upper cap wall and the cap side wall ordinarily is somewhat obtuse or 90°. It is important that the joining wall segments of upper and side cap walls be relatively rigid so that this angle also be the same when the inside pressure increases. Accordingly, as the upper cap wall increasingly bulges outward, the inside annular bead of the side wall of the cap is pressed more forcefully against the lower side of the lip at the mouth of the bottle and therefore the sealing is improved.

The preferred embodiment with a collar of an elephant-tusk cross-section preferably somewhat tapering upward achieves a smooth slipping into the mouth and a better compensation of dimensional fluctuations at the bottle mouth. Because of the rounded off outer surface of the collar, the sealing is restricted to a narrow annular zone, in contrast to the cylindrical collars of known closure caps wherein the sealing zone is very wide and therefoe the sealing pressure much less.

As regards closure means comprising a collar of known design, sealing is implemented at the zone of curvature from the inside of the mouth to the end surface of the mouth at the neck, provided the inside width of the mouth be narrower than the outside diameter of the seal, which is frequently the case. An excess of the sealing means beyond the inside width of the mouth is always required as otherwise no sealing effect is possible. Accordingly a conical deformation in the sealing collar that was manufactured in a cylindrical shape takes place in known closure means of a similar kind, with degrading effects once more on the sealing effectiveness.

BRIEF DESCRIPTION OF THE DRAWING

Further details of the invention will become clear in relation to the description below of its preferred embodiments and the drawing.

FIG. 7 is a cross-section of a further, especially preferred embodiment of the enclosure means of the invention, and FIG. 8 lastly is a part, seen from below, of the same closure means as in FIG. 7.

DETAILED DESCRIPTION OF THE EMBODIMENTS SHOWN IN THE DRAWING

Figure 1:
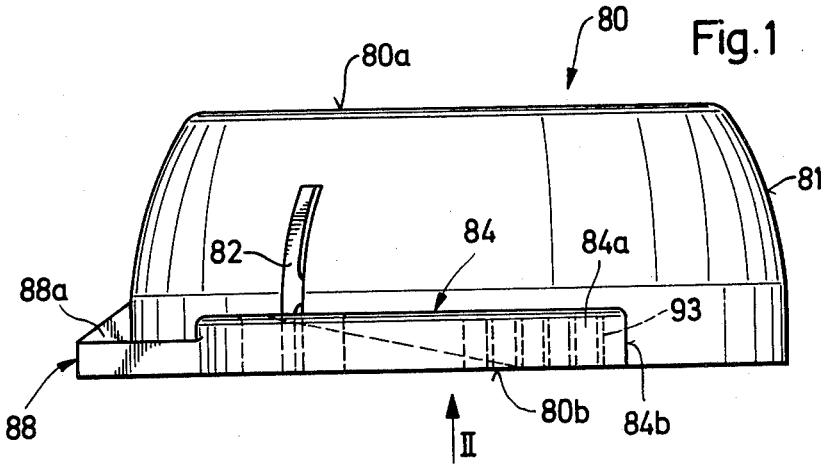
FIG. 1 is an especially simple embodiment, shown in side view, of the closure means of the invention.
Figure 2:
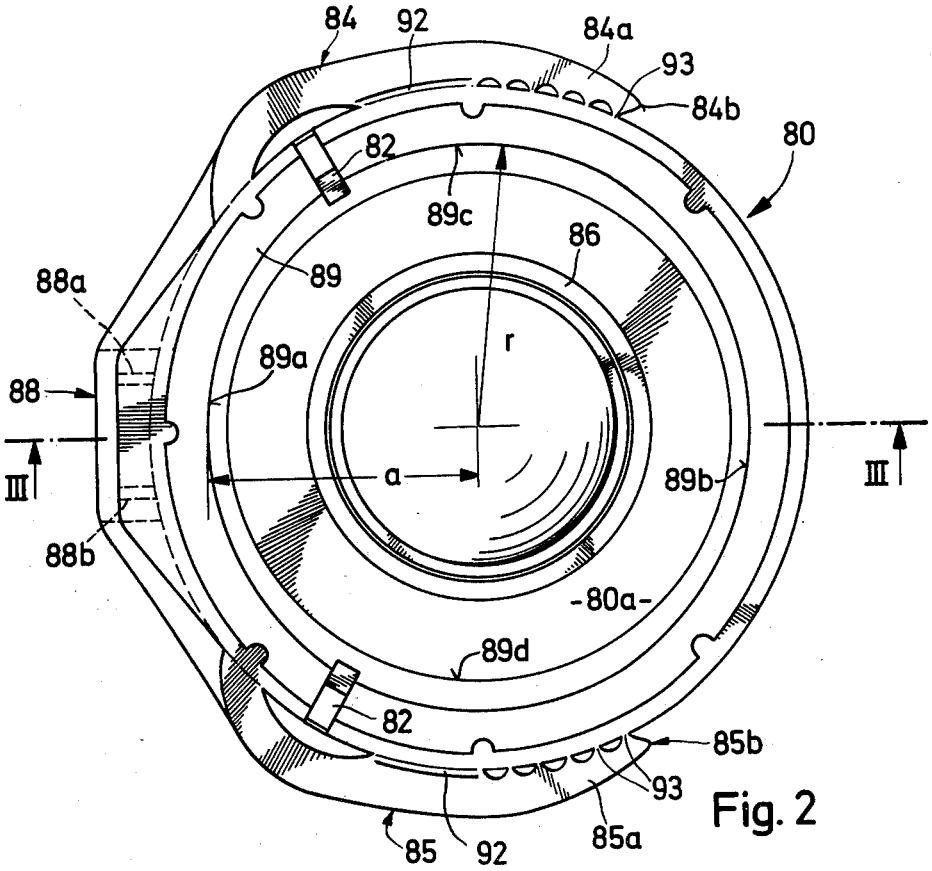
FIG. 2 is an inside topview of the embodiment of FIG. 1.
Figure 3:
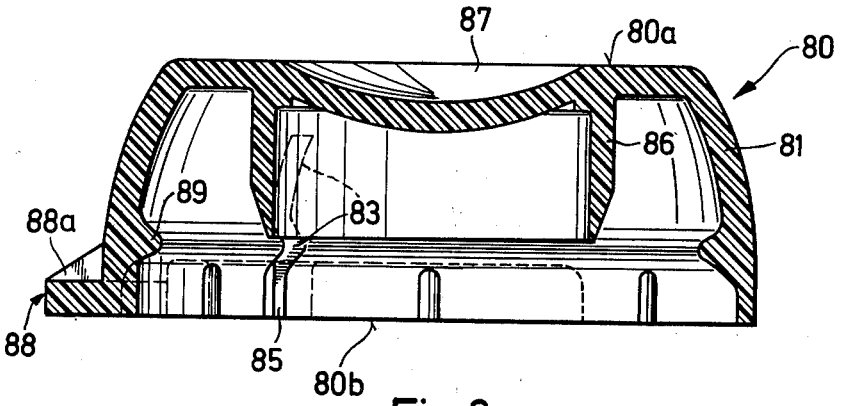
FIG. 3 is an axial section of the same embodiment along the plane denoted by III—III in FIG. 2.

In the first embodiment of the closure means of the invention shown in FIGS. 1 through 3, which is of the simplest design and can be easily manufactured, for instance by injection molding, the cap 80 comprises a roof wall 80*a* and a cap side wall 81. Said side wall 81 comprises two slits 82 and 83 extending axially from near the roof wall 80*a* to the lower circumferential rim 80*b* of the cap side wall 81, and opening in said rim. The two slits 82 and 83 are offset on the actuation side, where the cap 80 comprises an actuation beak 88 with two reinforcement means 88*a* and 88*b*, each by 60° toward the opposite side of the cap 80. Tensioning bridge members 84 and 85 are provided in the vicinity of the cap circumferential rim 80*b* for each of the slits 82 and 83, respectively which they span from both sides; said members are joined to the cap side wall 81. The inside surface of the cap side wall 81 comprises a projecting inside annular bead 89 of which the upper side presses against the lower side of the mouth lip 11 of the bottle neck when in the closed position.

Preferably the spacing a of the inside circumference of the inside annular bead 89 in the actuation region 89*a* from the center cap axis will be less than the spacing r of the intermediate sectors 89*c* and 89*d* containing the slits 82 and 83 and located between the actuation side and the opposite side from said axis. Again the spacing between the sector 89*b* of the inside annular bead 89 on the side of the cap opposite that to the actuation side from this axis preferably will be less than the distance r.

Thereby the inside annular bead 89 by means of those of its inside peripheral sectors corresponding to the outer actuation region 89*a* of cap 80 on one hand and to the opposite side 89*b* facing this region on the other hand, penetrates deeper into the constriction below the lip 11 of the mouth than by means of the intermediate sectors 89*c* and 89*d*, whereby a lever-like lifting of cap 80 is facilitated through its actuation beak 88.

When pressing the closure means on the neck of a bottle, the lower peripheral rim 80*b* passes the lip 11 of the mouth of the bottle with simultaneous spreading of the slits 82 and 83 and stretching of the tensioning bridge members 84 and 85. If the inside annular bead 89 is forced over and away from the lip 11, tensioning bridge members 84, 85 while compressing the open ends of the slits 82 and 83, respectively will contract and thereby increase the pressure of the surface of the inside annular bead 89 in all directions against the lower side of the lip 11 of the mouth.

A collar 86 is provided on the inside of the cap roof wall. Within the circumference of the collar 86, the roof wall 80*a* comprises a concave shallow 87 contributing to increase the pressure of the upper side annular bead 89 against the lower side of the mouth lip 11 as the internal pressure in the mouth of the bottle increases. The outer wall of the collar 86 furthermore can be provided with a number of parallel annular flanges 86*a* (FIG. 4) by means of which a seal similar to a labyrinth seal can be achieved by pressing against the inside mouth wall 10*a*, i.e. its rim, with the mouth end face 11*a*.

Figure 4:
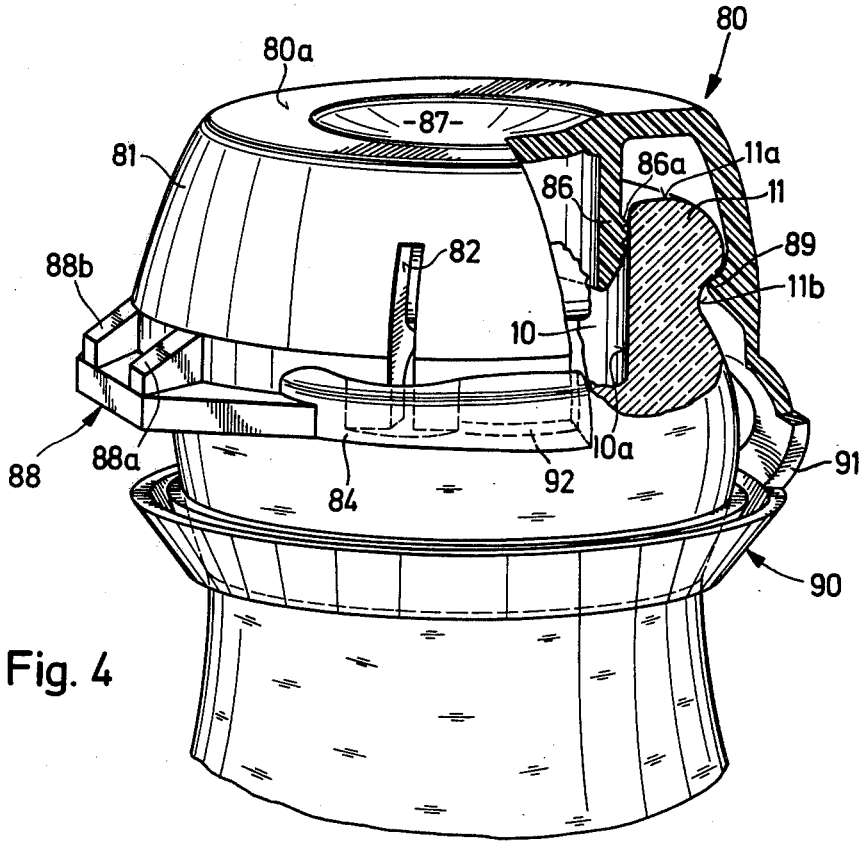
FIG. 4 is a view, partly in section, of an embodiment similar to those of FIG. 1 through 3 of the closure means with a collar, set on a bottle neck.

In the embodiment shown in FIG. 4, the cap 80 of the closure means comprises a collar 90 connected with it by means of a strip and preferably in integral manner.

When the cap design comprises such a collar 90, it does not pop off when the closure means is opened, so that the bottle together with the open cap mounted to it can easily be washed and sealed again.

On the other hand, to indicate that the bottle has remained closed following filling, an (omitted) signet skin may be provided in the slits 82 and 83 which resists the spreading of the slits 82 and 83 while being elongated when the cap is machine set on the filled bottle, but which when the cap 80 is removed manually by unilaterally lifting the actuation beak 88 will tear on account of the uneven distribution of the tension.

The bridge tensioning member 84 is joined to the side wall 81 near the lower rim 80*b* of the cap by means of a thin connecting strap 92, in conformity with the invention. The end 84*a* of the bridge tensioning member 84 facing away from the actuation region 89 is designed as a tear-open flap and is connected only by means of small, short strips 93 to the cap side wall 81, terminating in a tear-off beak 84*b* slightly projecting from the cap side wall 81.

When the cap 80 is automatically pressed on a freshly filled bottle by means of a known filling and sealing machine, the slits 82 and 83 supposedly are spread but in fact do so only to a minor extent because the bridge members 84 and 85 keep the slits substantially narrower due to their strong tangential tension than if there were none.

When the caps are made from the materials conventional in the injection molding process such as polyethylene or polypropylene, the tangential clamping of the bridge members and hence the sealing seat of the cap on the bottle mouth become so strong that on one hand from 6 to 8 atmospheres or more can be withstood inside the bottle, even allowing sterilizing the bottle content with the bottle sealed and temperature increased to 62° C. for at least 20 minutes, while on the other hand the machine-set cap can no longer be removed by finger pressure, for instance that of the thumb, against the front or lower side of the actuation beak 88, or only when exerting great force. Before the closure means of the invention of FIGS. 1 through 3 is removed, the end 84*a* of the tensioning bridge member 84 is therefore detached by lifting the beak 84*b* and first tearing off the short strips 93 and then, along the lower cap rim 80*a*, the longer connecting strap 92 from the cap side wall 81, whereby the slit 82 spanned by the bridge member 84 can spread further, so that the pressure of the inside annular rim 89 against the mouth lip 11 is substantially lowered, with the cap 80 still seated in sealing manner on the bottle but now removable from the bottle mouth 10 by a relatively low pressure from a finger against the actuation beak 88.

To replace the cap 80 on the bottle mouth 10, the high compression of a filling and sealing machine no longer is required, rather the cap 80 now can be replaced in sealing manner by pressing with the thumb on the bottle mouth 10. The cap 80 seals the remaining contents of the bottle hermetically against the outside air, but obviously it no longer can withstand pressures of several atmospheres. Nor is this required any more, as already part of the liquid bottle contents has been removed and a much larger space above the liquid now acts as a gaseous buffer, and obviously there will be no new sterilization of the bottle contents. Rather the bottle contents should be consumed as soon as possible. In any event the closure means still is set so tightly on the bottle that it can be laid on its side or even turned upside down without the cap being forced off or the bottle contents leaking out.

When the straps 92 and 93 of the lift-off end 84*a* of the bridge member 84 are not torn open, they indicate that the bottle has remained unopened. They act as a signet of warranty.

Figure 5:
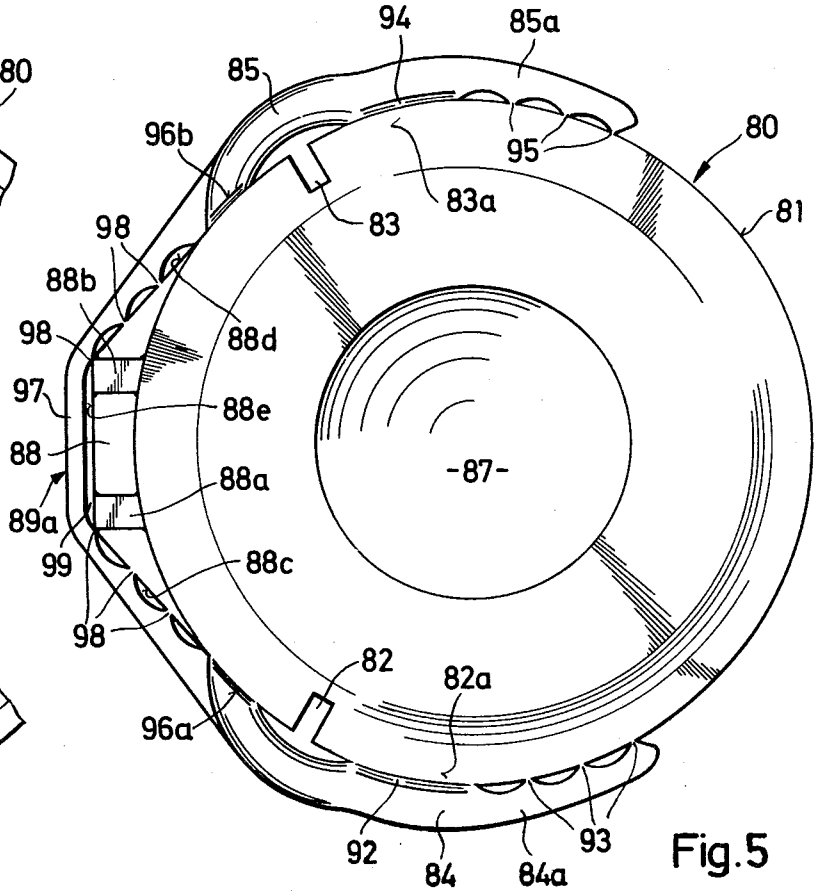
FIG. 5 is a top view of a further embodiment of the closure means.

In the embodiment of FIG. 5, both tensioning bridge members 84 and 85 are provided with tear-off ends 84*a* and 85*a* which are joined by relatively long connecting straps 92 and 94 located next to the slits to the outer circumferential sectors 82*a* and 83*a* facing away from the actuation area 89*a* of the cap 80 and by connecting straps 93 and 95 further away from the slits.

In this embodiment of the closure means of the invention first one of the two tear-up ends 84*a* and 85*a* and then the other can be torn up. This is recommended for closure means with especially tightly fitting material, in which tearing up one of the tear-up ends—for instance end 84*a*—in order to release the slit 82 by means of the actuation beak 88 does not suffice to effect easy removal of cap 80.

To prevent that when the cap 80 is replaced on the partly emptied bottle the torn-up ends 84*a* and 85*a* project in undesirable manner from the cap side wall 81, connecting straps 96*a* and 96*b* of a thinner design may also be provided on those sides of the slits 82 and 83 facing the actuation beak 88, and lastly a bridging element 97 may be provided around the actuation beak 88 so as to join together the two bridge elements 84 and 85 and to be itself connected in tear-off manner by means of short strips 98 with the flanks 88*c* and 88*d* of the actuation beak 88.

Thereby the two tensioning bridge members 84 and 85 together with the bridge element 97 connecting them can be completely removed from the cap side wall 81 and the actuation beak 88. The separation is further facilitated in that when manufacturing the cap 80, a slit 99 remains between the front face 88*e* of the actuation beak 88 and the bridge member 97.

Figure 6:
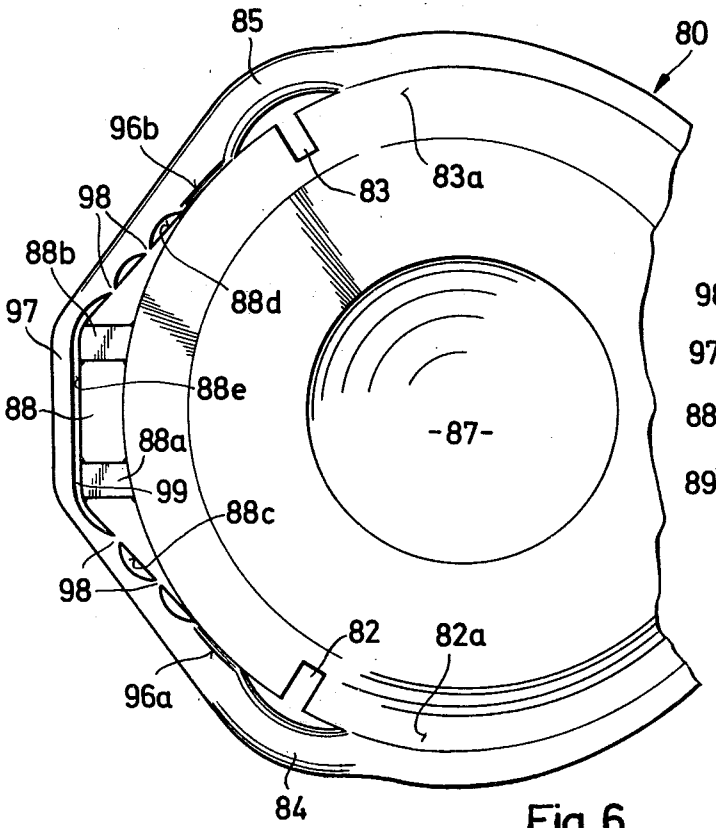
FIG. 6 is still a further embodiment of the same, in top view

In the embodiment of the closure means of the invention of FIG. 6, the tensioning bridge members 84 and 85 merge, without weakening of their cross-section, with the cap side wall 81 in the circumferential sectors 82*a* and 83*a* away from the actuation beak 88, and cannot be torn off.

On the other hand said members in the sectors near the slits 82 and 83 toward the actuation beak 88 are connected in tear-off manner by the thinner connecting straps 96*a* and 96*b* extending lengthwise along the peripheral rim, the bridge members 84 and 85 being joined by a bridge element 97, already cited, which in the manner already described is connected in tear-off manner by means of short tear-off strips 98 with the flanks 88*c* and 88*d* of the actuation beak 88, whereas the slit 99 remains between the front face 88*e* of the actuation beak 88 and the bridge element 97. This slit 99 in the embodiment of FIG. 6 extends around the front side 88*e* of the actuation beak 88 as far as its flanks 88*c* and 88*d* so that the bridge element 97 can be lifted off using the fingers and can be torn open on one side or both as far as one or both of the slits 82 and 83, the tip of the finger performing the tearing then being insertable into the bridge element 97 presently shaped like a bail. In this embodiment, the bridge element 97 and the tensioning bridge members 84 and 85 obviously remain connected to the cap side wall 81.

However it can be seen again with respect to the torn-up straps 96*a*, 96*b* and 98 that the bottle sealed by the cap 80 already was opened.

As regards the cap of the invention with tensioning bridge members which can be torn up on one or both sides, the actuation beak now can be designed to be substantially shorter than is the case for the embodiment of FIG. 27 through 31 of the German Offenlegungsschrift No. 2 554 887. This means a substantial saving in material when manufacturing the cap.

The simultaneous shortening and blunting also is advantageous regarding presorting by the sealing machine when in the feeding cycle. With the prior beak projecting more, one beak ran onto another and hence many closure means were in an oblique position, interfering with the feed operation.

The sealing cap shown in the embodiment of the invention of FIGS. 7 and 8—which obviously can also be equipped with tensioning bridge members tearing open on one or both sides, as shown in FIGS. 1 through 6—comprises an inside annular bead 99 of a side wall 101 of cap 100 which is at a distance d from the inside of the upper cap wall 100*a*. Wall 100*a* here is shown being plane, though it may also comprise a flat trough as indicated in FIGS. 3 and 4. The collar 106 in this embodiment extends almost down to the lower peripheral rim 100*b* of the cap side wall 101, and therefore is substantially longer than in the embodiments of FIGS. 1 through 6. Most significantly the outer side wall 107 of the collar 106 is convexly shaped toward the inside of the cap side wall 101 so that it is nearly spherical at its center. The cross-section of the maximum outside diameter f of the collar 106 is located at a distance e from the inside the upper wall 100*d* of the cap which exceeds the spacing d of the surface of minimum inside width of the inside annular bead 99. Preferably the inside 108 of the collar 106 also is spherical and convex. The lift-off beak 109 along its front rim comprises at its lower side a lift-off flange 102 with a rounded-off outwardly directed flank 103. The lift-off flange 102 is separated by a recess 104 from the lower peripheral rim 104*b* of the cap side wall 101, said recess if desired being open on the side of the lift-off flange 102. The flange 102 thereby will not project beyond the lower peripheral rim 100*b* of the cap side wall 101. The lift-off beak 98 is reinforced at its upper side by two braces 105 and 105*a*.

This embodiment furthermore comprises slits 112 and 113 and tensioning members 114 and 115 spanning them.

In manufacture, especially in injection molding, each slit may be covered on the outside of the cap by a thin film 112*a*, 113*a* that ordinarily would already tear when the closure cap of the invention is machine-set on a bottle mouth.

I claim:

1. A closure for hermetically sealing and for easily resealing a bottle or a similar container, which bottle comprises a neck with a discharge orifice, a neck end surface surrounding said orifice and a mouth lip having a constriction at its lower side, said closure comprising a cap having a roof wall and a cap side wall circumferential to said roof wall and comprises slits extending transversely from the lower rim of said cap and being adapted for spreading when said cap is set on the mouth of the bottle, said cap further comprising an inside annular rim on the inside of the cap side wall projecting inward and being adapted for engaging the lower side of the mouth lip of the bottle, when in closed condition, a sealing means is mounted to the inside of the roof wall for sealing the discharge orifice of the bottle when closed by said cap, a finger-actuated lift-off element in a sector of said cap side wall which sector serves as actuation side, and a fastening device associated with said slits and comprising, for each slit present in the cap side wall, at least one tensioning member curvedly bridging such slit, said tensioning member having two ends each of which ends merge with said cap side wall on opposite sides of the bridged slit, at least one of said ends of said tensioning member being connected in a sector of the cap side wall away from the actuation side, said tensioning member being tensioned in the closed condition by a stretching force tangential to the cap side wall and thus effecting a compression of every slit present in the side wall and thereby a sealing pressure of the inside annular bead against the lower side of the mouth lip of the bottle neck; the tensioning member of at least one slit further comprising, at at least one of its said tension member ends and at least on that side of said slit bridged thereby which is located in a sector of the cap side wall away from the actuation side, at least one tear-up strap of reduced cross section by means of which strap said tension member end is connected to said cap side wall and which strap can be torn away from said cap side wall, when the closure, after being mounted on a bottle for the first time, is opened for the first time, whereby the tangential stretching and hence the ensuing compression of the particular slit is alleviated; and the cap can be reseated more easily on the bottle to close the latter after the first opening.

2. The closure of claim 1, wherein the tensioning member comprises tear-up straps on both sides of the bridged slit, by means of which straps said tensioning member is connected to the cap side wall.

3. The closure of claim 1, wherein the cap side wall consists of two slits in opposite sectors adjacent the actuation side of the cap side wall, and wherein one tensioning member is provided for each slit, each said tensioning member being elastically stretchable and being joined, on both sides of the slit it spans and close to it, to the cap side wall, and wherein at least one of the two tensioning members comprises on at least one side of the slit it spans, a strap by means of which that tensioning member is connected to the cap side wall, which strap can be torn up in the tangential direction.

4. The closure of claim 1, wherein said lift-off element is connected integrally and rigidly to the cap side wall and wherein at least one tensioning member comprises a lift-off arm which extends on that side of the slit, bridged by the last-mentioned tensioning member, which is away from the lift-off element along the cap side wall.

5. The closure of claim 4, wherein the lift-off arm comprises a small tear-up strip toward its free end, by means of which said lift-off arm is connected to the cap side wall.

6. The closure of claim 5, wherein said fastening device comprises only two tensioning members, one to each side of said lift-off element, and a bridge element at the periphery of the cap side wall which bridge element connects the two tensioning members with one another, and wherein each tensioning member comprises a strap being located on that side of said tensioning member between the slit spanned by the same and the bridge element and connecting said tensioning member with the cap side wall, and which strap can be torn open in the tangential direction.

7. The closure means of claim 6, wherein said bridge element comprises at least one tear-open strap by means of which said bridge element is connected to the lift-off element.

8. The closure of claim 7, wherein a sector of the bridge element is located in front of a forward face of the lift-off element, said sector being free from straps and being adapted to be lifted from the lift-off element prior to the first opening of the closure means, when the strap-connection between at least one of said tensioning members and the cap side wall is torn open on at least one side of the slit which said last-mentioned tensioning member spans.

* * * * *